US008193689B2

(12) United States Patent
Panyik et al.

(10) Patent No.: US 8,193,689 B2
(45) Date of Patent: Jun. 5, 2012

(54) METAL HALIDE LAMP SHROUDING

(75) Inventors: Tamas Panyik, Budapest (HU); Istvan Maros, Budapest (HU); Csaba Horvath, Budapest (HU)

(73) Assignee: General Electric Company, Schenectady, NY (US)

( * ) Notice: Subject to any disclaimer, the term of this patent is extended or adjusted under 35 U.S.C. 154(b) by 61 days.

(21) Appl. No.: 12/901,694

(22) Filed: Oct. 11, 2010

(65) Prior Publication Data

US 2012/0086333 A1 Apr. 12, 2012

(51) Int. Cl.
*H01J 5/48* (2006.01)
*H01J 5/38* (2006.01)

(52) U.S. Cl. ..... 313/318.07; 313/318.01; 313/623

(58) Field of Classification Search ..... 313/25, 313/623, 318.01, 318.03, 318.06, 318.07, 313/639–641

See application file for complete search history.

(56) References Cited

U.S. PATENT DOCUMENTS 5,528,106 A 6/1996 Jansen et al.
5,726,525 A 3/1998 Friederichs
5,825,129 A * 10/1998 Van der Leeuw et al. .... 313/634
5,969,468 A * 10/1999 Fitzpatrick et al. ..... 313/318.07
6,060,820 A * 5/2000 Noll et al. ..... 313/113

FOREIGN PATENT DOCUMENTS

EP 0 455 295 A1 11/1991

* cited by examiner

*Primary Examiner* — Karabi Guharay
(74) *Attorney, Agent, or Firm* — Fay Sharpe LLP

(57) ABSTRACT

A discharge lamp such as a shrouded metal halide lamp is designed to reduce the potential for arcing under hot restart or restrike voltages. A stepped conformation of the pinch seal region limits arcing within the shroud while different dimensions of stems in the base increase the distance between outer lead wires in the base to prevent arcing externally of the shroud.

19 Claims, 3 Drawing Sheets

METAL HALIDE LAMP SHROUDING

BACKGROUND OF THE DISCLOSURE

This disclosure relates to a discharge lamp, and more particularly to a shrouded metal halide discharge lamp. The disclosure finds particular application in association with starting of a high intensity discharge (HID) lamp at an elevated starting voltage, on the order of five to twenty (5-20) kilovolts (kV), which can cause undesired arcing.

It is known that metal halide lamps, as is typical with other types of lamps, can be started either cold or hot. By cold starting is meant lamp ignition that occurs when the lamp is at approximately room temperature, or within approximately 20-30% of its operating temperature. In such an instance, the lamp can be started at a moderate ignition voltage level, on the order of approximately 1-6 kV. Once the lamp has warmed up and is at a temperature closer to the operating temperature of the lamp, so-called hot starting requires an ignition pulse on the order of approximately 10-25 kV. The higher ignition voltage required to hot start a lamp can cause potential arcing issues both inside and outside of the shrouded lamp. That is, the lamp is typically connected to a base typically formed from a ceramic or other insulative material that accommodates a base portion of the shrouded lamp. Two electrical lead wires extend through the base and are spaced a predetermined dimension apart, which dimension may vary depending on the lamp type. Depending on the distance and lamp operation, a breakover voltage, i.e., that voltage at which arcing may occur, is preferably not higher than approximately 10-13 kV. However, under certain conditions and lamp geometries higher voltage is needed to hot start the lamp.

Prior arrangements fill the base with an electrically insulating potting material such as different ceramics and plastics in an effort to address the high voltage arcing situation in that region of the lamp assembly. In still other instances, different geometries have been designed to maximize the distance between electric lead wires. In another instance, a recess is fox to extend from one face of the pinch seal and the base is specially modified to increase a length of a boundary between current supply conductors. However, such an arrangement requires a modified base and a complete recess in the pinch seal.

While the above noted arrangements particularly address the distance between the lead wires outside of the lamp, there is also a need to improve the potential arcing issue inside the shrouded lamp. That is, arcing can potentially occur between the lead wires or what is sometimes referred to as the support rib and lead wire adjacent a capped end of the lamp inside the shroud. Again, the potential arcing issue arises from the need for an ignition pulse for stable starting that may range on the order of 10-25 kV for hot starting.

In one prior art arrangement, the potential arcing issue inside the shrouded lamp was addressed by placing an insulating sleeve over an extended length of the support rib that extends from a proximal end of the lamp assembly adjacent the pinch seal to a distal end located remotely from the pinch seal. It is known to employ a glass tube, for example, that extends along a substantial portion of the length of the support rib to act as an additional insulator in an effort to address the arcing issue inside the shroud. However, the insulating glass is typically of a different material than that of the shroud and, as a result, residual stresses are created from using the additional glass sleeve over a portion of the elongated support rib. The residual stress can lead to cracking or premature failure of the lamp so that an alternative arrangement is desired in order to address the arcing issue without creating residual stress.

Consequently, a need exists for an improved light or lamp assembly that addresses arcing both within the shrouded lamp, and also externally thereof, and preferably in a manner that uses similar components to existing lamp arrangements so that an improved lamp can be provided without undue modification or cost, and that is less susceptible to arcing in a hot restart situation.

SUMMARY OF THE DISCLOSURE

A discharge lamp includes an arc tube having a discharge chamber and first and second electrodes disposed in spaced relation in the discharge chamber. A shroud is received around the arc tube having a closed end and a pinch seal end spaced therefrom. First and second lead assemblies have first ends extending from the pinch seal end and second ends electrically connected to the first and second electrodes, respectively. A base has a cavity that receives the pinch seal end of the shroud. First and second annular stems extend different dimensions in the base cavity and are received in respective first and second recesses in the pinch seal end of the shroud to limit arcing between the lead assemblies.

The first and second recesses extend different dimensions into the pinch seal end of the shroud.

The first and second lead assemblies include thin seal foils that are axially offset within the pinch seal end of the shroud.

In another exemplary embodiment, the pinch seal end has a stepped configuration and the pinch seal extends substantially different dimensions along the first and second lead assemblies.

The first lead assembly is received in the increased axial dimension of the first stem and the extended axial dimension of the stepped pinch seal.

One benefit is the ability to hot restart a lamp without causing arcing inside or outside of the lamp.

Yet another benefit resides in the ease with which existing lamp assemblies and components can be converted.

Still another advantage is associated with limiting arcing issues without introducing residual stress.

Still features and benefits of the present disclosure will become more apparent to those skilled in the art upon reading and understanding the following detailed description.

DETAILED DESCRIPTION

Figure 1:
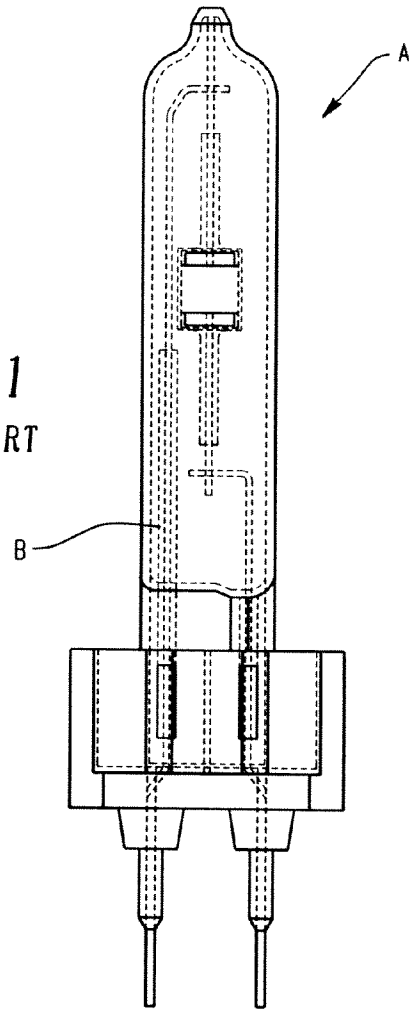
Fig. 1 PRIOR ART
FIG. 1 is an elevational view of a prior art lamp.

FIG. 1 illustrates a prior art discharge lamp A that employs an insulating sleeve B disposed along the support rib of one of the electrical lead assemblies of the lamp. As noted in the Background, unfortunately this arrangement created a residual stress that leads to premature failure of the lamp.

Thus, this solution to resolving potential arcing associated with elevated hot start voltage levels is not deemed to be a reliable solution.

Figure 2:
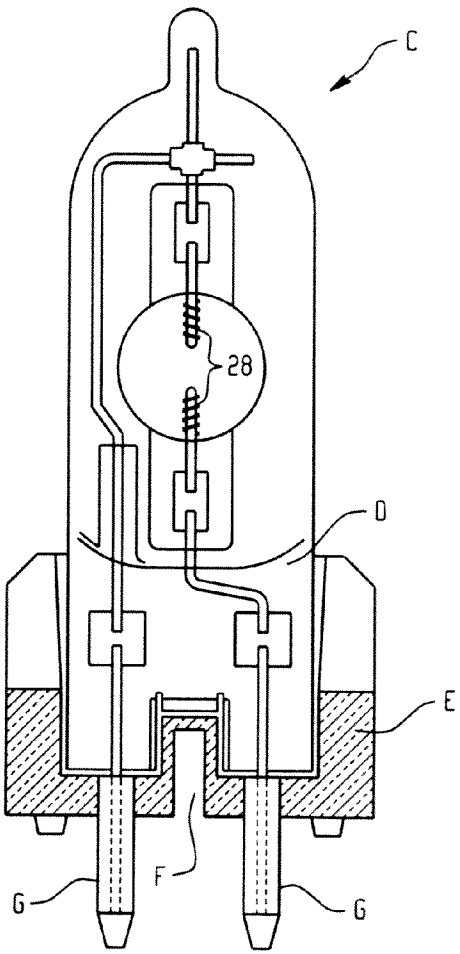
Fig. 2 PRIOR ART
FIG. 2 is an elevational view, partly in cross-section, of another prior art lamp.

In FIG. 2, prior art lamp C is also an arc discharge lamp and is more completely shown and described in published EP 0 455295 A1. The pinch seal portion D of this lamp is received in base E and the pinch and base are modified to form a recess F that increases the distance between exposed portions of current supply conductors G. This configuration is directed to addressing flash-over or arcing resulting between exposed portions of the current supply conductors externally of the shroud.

Figure 3:
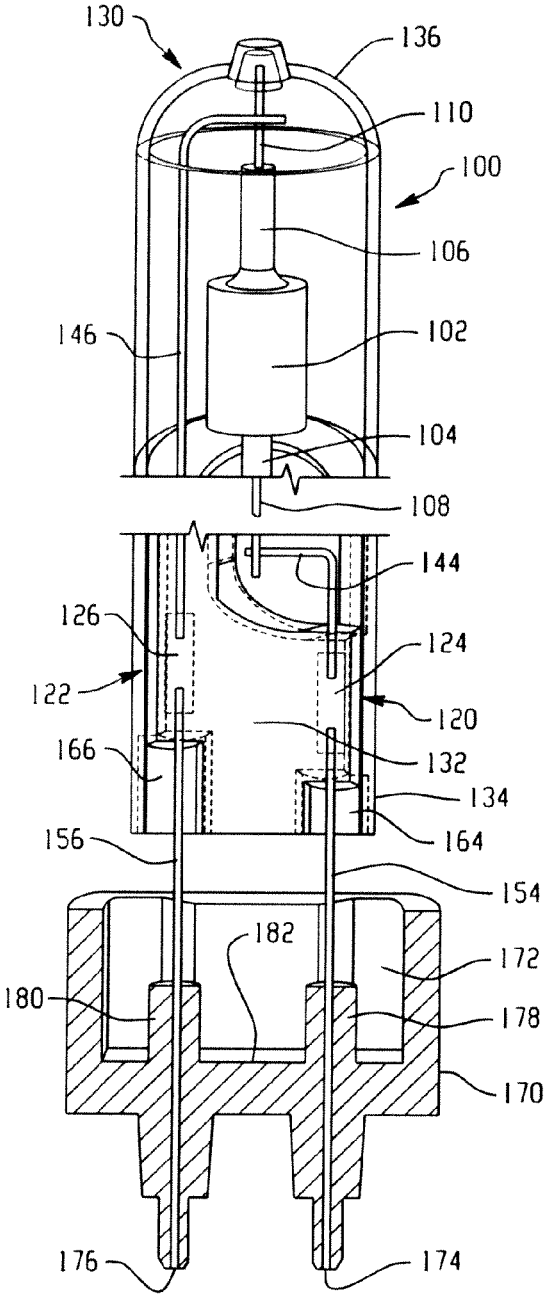
FIG. 3 is an elevational view, partly in cross-section, of an exemplary embodiment providing one aspect for addressing the arcing issue.

In an exemplary embodiment of the present disclosure shown in FIG. 3, discharge lamp 100 includes an arc tube or light source 102 having first and second legs 104, 106 extending from a central body portion that includes the discharge chamber. First and second electrodes 108, 110 extend from the spaced relation in the discharge chamber, through a respective leg 104, 106, and have portions that extend outwardly of the leg. The electrodes 108, 110 are, in turn, mechanically supported and electrically connected to first and second lead assemblies 120, 122. More particularly, each lead assembly 120, 122 preferably includes a thin conductive foil such as a molybdenum foil 124, 126 embedded and sealed in an outer shroud 130, and more particularly in a pinch seal portion 132 located at a first or proximal end 134 spaced from a second or distal or closed end 136. The shroud encloses the arc tube and first or inner leads 144, 146 are mechanically and electrically connected to the molybdenum foils 124, 126 in the pinch region 132 and extend into the enclosed cavity of the shroud for connection with respective first and second electrodes 106, 108. In addition, second or outer leads 154, 156 are likewise mechanically and electrically connected to the respective molybdenum foils 124, 126 and extend outwardly from the pinch seal region 132. These outer leads 154, 156 pass through recesses 164, 166 that extend generally axially inward from the terminal edge of the pinch seal region toward the molybdenum foils 124, 126. In the exemplary embodiment, each of the recesses 164, 166 has a generally closed end, cylindrical conformation with the respective outer lead 154, 156 extending substantially along the longitudinal axis of this cylindrical conformation. The outer leads 154, 156 continue outwardly from the shroud 130 and are received in a base 170, and more particularly a cavity 172 of the base through respective openings 174, 176. The base openings 174, 176 communicate with the cavity at one end and communicate outwardly from the base at another end. Stems 178, 180 extend axially inwardly into the cavity 172 from a generally planar end face 182 of the cavity. The end face 182 abuttingly receives the terminal end of the shroud along the pinch seal portion 132. In addition, when fully assembled, the recesses 164, 166 extending inwardly in the pinch portion of the shroud are closely received over the outer surfaces of respective stems 178, 180. The outer leads 154, 156 proceed through the openings 174, 176 for external mechanical and electrical connection with electrical conductors (not shown).

As is evident in FIG. 3, one of the stems 178, 180 has a dimension or height greater than the other, i.e., the first and second annular stems extend different dimensions into the cavity of the base. Likewise, recesses 164, 166 formed in the pinch seal end of the shroud are also of a different dimension or length to accommodate and closely receive the annular stems of the base. In this manner, the length of the path between exposed portions of the outer leads 154, 156 is increased as a result of the increased height associated with the stem 180. This increased length addresses the arcing issue in the base between the lead wires, i.e., externally of the lamp shroud. As is also evident in FIG. 3, the corresponding molybdenum foils 124, 126 are axially offset from one another, although this may not necessarily be required.

Figure 4:
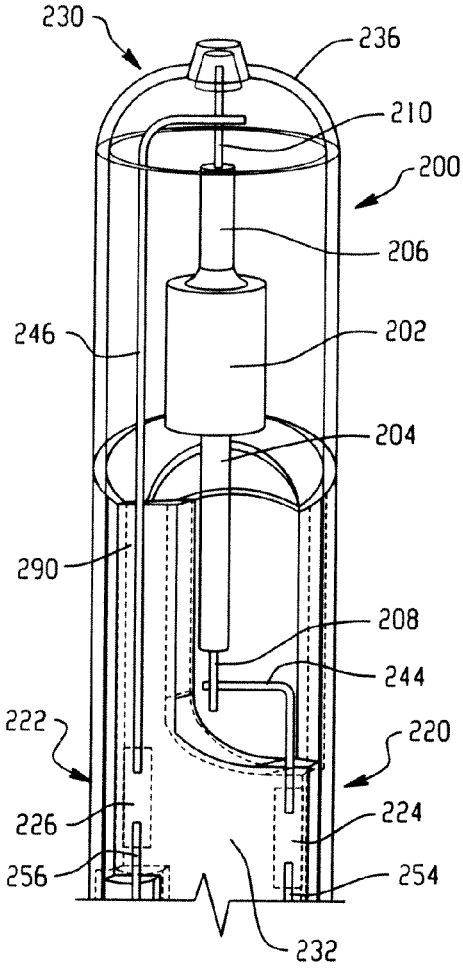
FIGS. 4 and 5 are elevational views of a portion of the lamp illustrating another manner of addressing the arcing issue within the lamp.
Figure 5:
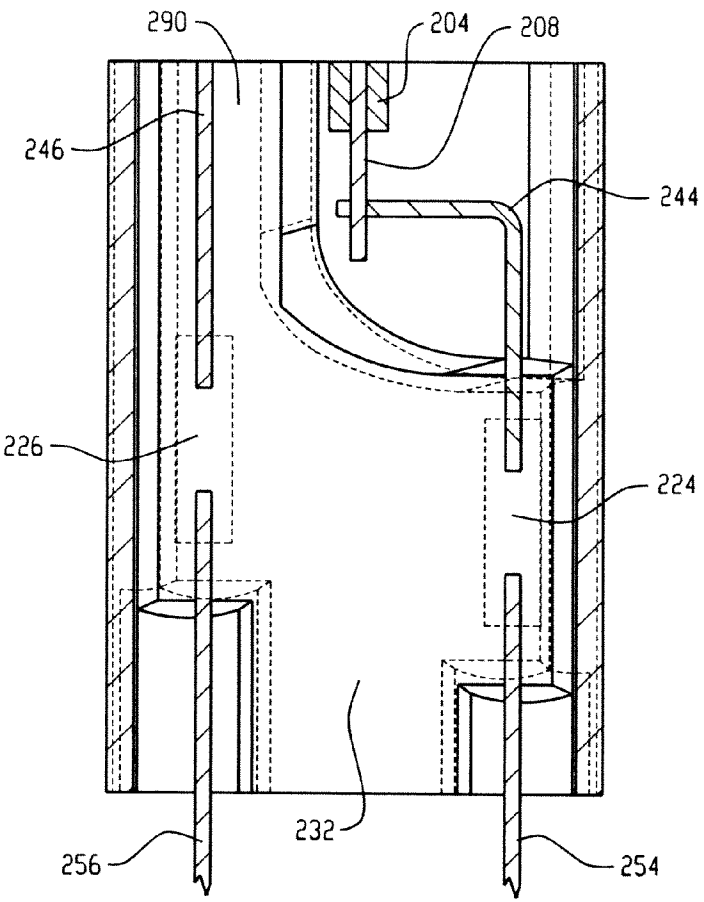

An exemplary second embodiment is shown in FIGS. 4 and 5. In particular, where possible, like reference numerals refer to like components increased by a factor of one hundred, e.g., lamp 100 of FIG. 3 is now identified as lamp 200 in FIGS. 4 and 5. The structure of lamp 200 is particularly intended to address arcing between the lead assemblies within the shroud 230. Again, arc tube 202 has first and second legs 204, 206 extending axially therefrom and the arc tube is supported in the shroud 230 by outer portions of the electrodes 208, 210 being electrically connected to and mechanically supported by inner leads 244, 246 of the lead assemblies 220, 222. Here, pinch seal region 232 desirably has a stepped configuration in which extended portion 290 of the pinch seal region envelops or encases an extended length of the inner lead or support rib 246 of the lead assembly 222. As is particularly illustrated in FIGS. 4 and 5, this results in an increased distance between the exposed portions of the inner leads 244, 246. Further, this extension 290 of the pinch seal region along the support rib 246 is also preferably made from the same material as the remainder of the shroud 230. This avoids the prior art issues of glass sleeves creating residual stress in the lamp assembly of the type shown in FIG. 1 as a result of the sleeve being formed of a different material than the shroud. The different materials created residual stress issues as noted above, whereas the structure of FIGS. 4 and 5 overcomes this problem by employing the stepped configuration of the pinch seal region. In this manner, arcing between the leads 244, 246 within the shroud is less likely to occur in the case of a cold start, and even when exposed to elevated restart voltages associated with a hot strike or restart on the order of 5-20 kV.

Figure 6:
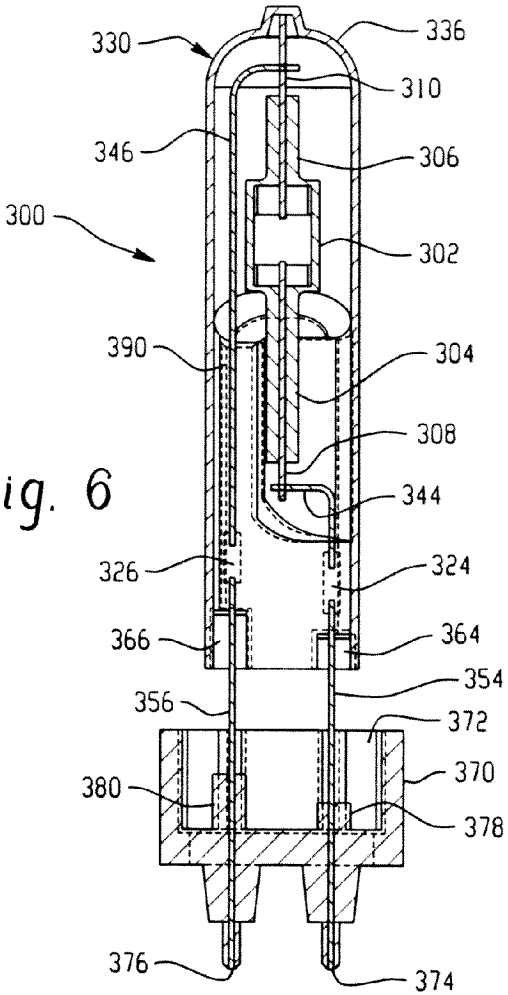
FIG. 6 is an elevational view, partly in cross-section, of a lamp using both embodiments of FIGS. 3-5.

The exemplary embodiment of FIG. 6 includes concepts from the embodiments of FIG. 3 and FIGS. 4/5. Again, for ease of illustration and purposes of brevity, like reference numerals refer to like components in the 300 series. That is, lamp 100 described in FIG. 3 and lamp 200 described in the embodiment of FIGS. 4 and 5 is now referred to as lamp 300 in FIG. 6. This embodiment uses different dimensions for the annular stems 378, 380 formed in the base to address the arcing issue externally of the shroud 330. In addition, the stepped region 390 of the pinch seal extends along a substantial axial portion of the support rib 346 in order to increase the dimension between the leads 344, 346 within the shroud. By increasing the distance between the lead wires that are at different electric potential, the arcing problem is resolved. The special pinching technique or stepped configuration increases the height of the pinched area along the support rib. This eliminates the need for a totally covered lead wire and the insulating tube can be pinched into the shroud for a more precise, certain insulative effect. Likewise, the different dimensions of the stems surrounding the outer leads where the leads pass through the base 370 increase the distance between the electrical leads. This addresses higher ignition voltage arcing issues outside of the shrouded lamp as demonstrated by the embodiment of FIG. 6. It is recognized that both of these features can be incorporated into a lamp arrangement.

The disclosure has been described with reference to the preferred embodiments. Obviously, modifications and alterations will occur to others upon reading and understanding the preceding detailed description. It is intended that the disclosure be construed as including all such modifications and alterations.

What is claimed is:

1. A discharge lamp comprising:

an arc tube having a discharge chamber;

first and second electrodes disposed in spaced relation in the discharge chamber;

a shroud received around the arc tube having a closed end and a pinch seal end spaced therefrom;

first and second lead assemblies having first ends extending from the pinch seal end and second ends electrically connected to the first and second electrodes, respectively;

a base having a cavity receiving the pinch seal end of the shroud; and first and second annular stems extending different dimensions into the base cavity and received in respective first and second recesses formed in the pinch seal end of the shroud to limit arcing between the lead assemblies.

2. The discharge lamp of claim 1 wherein the first and second recesses extend different axial dimensions into the pinch seal end.

3. The discharge lamp of claim 1 wherein the first and second lead assemblies each include thin seal foils sealed in the pinch seal end of the shroud and electrically connected to inner leads that extend for connection with the first and second electrodes, respectively, and outer leads that extend through respective openings in the base stems.

4. The discharge lamp of claim 3 wherein the thin seal foils are axially offset within the pinch seal end of the shroud.

5. The discharge lamp of claim 1 wherein the pinch seal end has a stepped configuration and the pinch seal extends substantially different dimensions along the first and second lead assemblies.

6. The discharge lamp of claim 5 wherein the first lead assembly is received in the increased axial dimension of the first stem and the extended axial dimension of the stepped pinch seal.

7. The discharge lamp of claim 5 wherein the extended axial dimension of the stepped pinch seal extends in substantially parallel, offset relation to a first leg of the arc tube.

8. A discharge lamp comprising:

an arc tube having a discharge chamber;

first and second electrodes disposed in spaced relation in the discharge chamber;

a shroud received around the arc tube having a closed end and a pinch seal end spaced therefrom; and first and second lead assemblies having first ends extending from the pinch seal end and second ends electrically connected to the first and second electrodes, respectively, wherein the pinch seal end has a stepped configuration and the pinch seal extends substantially different dimensions along the first and second lead assemblies.

9. The discharge lamp of claim 8 wherein the first lead assembly is received in the increased axial dimension of the first stem and the extended axial dimension of the stepped pinch seal.

10. The discharge lamp of claim 8 wherein the extended axial dimension of the stepped pinch seal extends in substantially parallel, offset relation to a first leg of the arc tube.

11. The discharge lamp of claim 8 further comprising a base having a cavity receiving the pinch seal end of the shroud, and first and second annular stems extending different dimensions into the base cavity and received in respective first and second recesses formed in the pinch seal end of the shroud for limiting arcing between the lead assemblies.

12. The discharge lamp of claim 11 wherein the first and second recesses extend different axial dimensions into the pinch seal end.

13. The discharge lamp of claim 11 wherein the first and second lead assemblies each include thin seal foils sealed in the pinch seal end of the shroud and electrically connected to inner leads that extend for connection with the first and second electrodes, respectively, and outer leads that extend through respective openings in the base stems.

14. The discharge lamp of claim 13 wherein the thin seal foils are axially offset within the pinch seal end of the shroud.

15. A discharge lamp comprising:

an arc tube having a discharge chamber;

first and second electrodes disposed in spaced relation in the discharge chamber;

an elongated light transmissive shroud received around the arc tube having a closed end and a pinch seal end spaced therefrom;

first and second lead assemblies having first ends extending from the pinch seal end and second ends electrically connected to the first and second electrodes, respectively, wherein the pinch seal end has a stepped configuration and the pinch seal extends substantially different dimensions along the first and second lead assemblies;

a base having a cavity receiving the pinch seal end of the shroud; and first and second annular stems extending different dimensions into the base cavity and received in respective first and second recesses formed in the pinch seal end of the shroud to limit arcing between the lead assemblies.

16. The discharge lamp of claim 15 wherein the first and second recesses extend different axial dimensions into the pinch seal end.

17. The discharge lamp of claim 15 wherein the extended axial dimension of the stepped pinch seal extends in substantially parallel, offset relation to a first leg of the arc tube.

18. The discharge lamp of claim 15 wherein the first and second recesses extend different axial dimensions into the pinch seal end.

19. The discharge lamp of claim 11 wherein the first and second lead assemblies each include thin seal foils axially offset from one another and sealed in the pinch seal end of the shroud and electrically connected to inner leads that extend for connection with the first and second electrodes, respectively, and outer leads that extend through respective openings in the base stems.

* * * * *